US009197006B2

(12) United States Patent
Hack

(10) Patent No.: US 9,197,006 B2
(45) Date of Patent: Nov. 24, 2015

(54) ELECTRICAL CONNECTOR HAVING MALE AND FEMALE CONTACTS IN CONTACT WITH A FLUID IN FULLY MATED CONDITION

(71) Applicant: Northrop Grumman Systems Corporation, Falls Church, VA (US)

(72) Inventor: Harvey Hack, Annapolis, MD (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 43 days.

(21) Appl. No.: 13/933,542

(22) Filed: Jul. 2, 2013

(65) Prior Publication Data

US 2015/0011107 A1 Jan. 8, 2015

(51) Int. Cl.

*H01R 13/52* (2006.01)
*H01R 13/523* (2006.01)
*H01R 13/629* (2006.01)

(52) U.S. Cl.

CPC ..... *H01R 13/523* (2013.01); *H01R 13/52* (2013.01); *H01R 13/62938* (2013.01); *Y10T 29/49117* (2015.01)

(58) Field of Classification Search

USPC ..... 439/201, 271, 283, 191
See application file for complete search history.

(56) References Cited

U.S. PATENT DOCUMENTS 4,039,242 A 8/1977 Wilson et al.
4,174,875 A 11/1979 Wilson et al.
4,192,569 A 3/1980 Mucci
4,795,359 A * 1/1989 Alcock et al. ..... 439/271
5,645,442 A 7/1997 Cairns
5,772,457 A 6/1998 Cairns
5,899,765 A * 5/1999 Niekrasz et al. ..... 439/201
6,315,461 B1 11/2001 Cairns
6,340,303 B2 * 1/2002 Hamada et al. ..... 439/127
6,475,008 B1 * 11/2002 Marolda et al. ..... 439/271
6,511,335 B1 1/2003 Rayssiguier et al.
7,108,549 B2 * 9/2006 Lyu et al. ..... 439/587
7,112,080 B2 9/2006 Nicholson
7,465,177 B2 * 12/2008 Wood ..... 439/191
7,500,859 B2 * 3/2009 Dubranna ..... 439/140
7,533,461 B2 5/2009 Griffiths
7,695,301 B2 4/2010 Mudge, III et al.
7,731,515 B2 * 6/2010 Nicholson ..... 439/201
7,959,454 B2 6/2011 Ramasubramanian et al.
8,267,707 B2 9/2012 Rogers
8,272,885 B2 9/2012 Pearce et al.
8,292,645 B2 10/2012 Cairns
8,376,765 B2 2/2013 Chaize (Continued)

FOREIGN PATENT DOCUMENTS

EP 2 355 258 A1 8/2011
WO WO 2011/141565 A1 11/2011

*Primary Examiner* — Chandrika Prasad
(74) *Attorney, Agent, or Firm* — Alston & Bird LLP

(57) ABSTRACT

A wet-mateable electrical connection and an associated method are provided for use, for example, within an adverse environment such as underwater. A wet-mateable electrical connection may include a female connector body comprising at least one receptacle. A female contact is disposed within the at least one receptacle. A male connector body having at least one axially directed male contact pin having a forward end portion releasably engages with the female contact body within the receptacle, thus forming a fully-mated engagement. In the fully-mated engagement, the electrical contacts are in contact with water/fluid. Thus, the electrical connection is established even in the presence of water/fluid.

18 Claims, 11 Drawing Sheets

(56) References Cited

U.S. PATENT DOCUMENTS 8,814,584 B2 * 8/2014 Allton ..... 439/198
2005/0042903 A1 * 2/2005 Nicholson ..... 439/201
2011/0021049 A1 1/2011 Ramasubramanian et al.
2011/0189878 A1 8/2011 Rogers

* cited by examiner

ELECTRICAL CONNECTOR HAVING MALE AND FEMALE CONTACTS IN CONTACT WITH A FLUID IN FULLY MATED CONDITION

FIELD

The present invention generally relates to wet-mateable connectors that can be mated and de-mated in adverse environments, such as underwater. In particular, this invention relates to an electrical connector that can be used to provide power and data communications within an adverse environment, such as underwater in a well-head or in a sub-sea oil well.

BACKGROUND

Multiple complex machines and instruments are needed for monitoring and conducting various industrial activities in adverse environments. For example, deep-sea oil drilling or a well-drilling through a petroleum reservoir requires multiple instruments to monitor the progress, carefully balance the physical parameters, or determine the status of the surroundings. In the case of a petroleum reservoir, reservoir parameters such as pressure, temperature, fluid flow rate, and the like provide useful information about the status of the reservoir and the development of the well.

Sensors that are responsive to these parameters are being used in the industry to obtain the status updates and monitor the progress of underwater operations. The monitors are suitably positioned within the well such that the information regarding the reservoir parameters can be obtained. The sensor takes the measurements and transmits the measurements to a data recorder that is coupled to the reservoir or to a work station (e.g., computer) or a control module on the surface.

Operation of instruments such as sensors requires electrical and data connections between these machines. Often, these connections must be made within the adverse environment, such as within the wellbore. Such connections may require "wet-mateable" electrical or data connectors.

The wet-mateable electrical connection must be reliable to ensure the proper monitoring of the reservoir parameters. For example, in deep sea well-drilling, the wellhead assembly and the valve system are installed separately. Thus, a wet-mateable connector is required to make a connection at the wellhead. For such an operation, the electrical connection must be durable because the wellhead assembly and the valve system are permanently installed on the sea floor. Additionally, since a high voltage is often required for operation of downhole equipment and sensors, the electrical connection should be able to insulate high voltage after being pressure sealed from conductive seawater and/or production of well-fluid.

A challenge in making wet-mateable electrical connections is the ability to protect the electrical contacts from influx of seawater and/or well-fluid. Currently, this challenge has been addressed in many ways. A general premise of current protection methods is the insulation of the electrical connects from water or fluids. For example, U.S. Pat. No. 4,795,359 to Alcock, et al. is directed to a wet-mateable electrical connector where the male connector and the female connector are enclosed within closed chambers that contain electrically insulating media, such as grease or oil. The electrically insulating media provides a protected area around the connection between contact pin and the contact socket within the female connector body.

U.S. Pat. No. 4,174,875 to Wilson, et al. discloses an electrical insulation of male and female connectors of a wet-mateable electrical connection using a rigid dielectric material disposed between them. U.S. Pat. No. 5,772,457 to Cairns discloses a plurality of electrically-conductive sockets where each socket assembly is pressure compensated to the ambient external pressure by means of one or more of resilient bladders filled with dielectric fluid. Several other wet-mateable electrical connections are known in the art and disclose similar techniques for insulating the electrical contacts. See for example, U.S. Pat. Nos. 4,039,242, 5,645,442, and 4,192,569.

In addition to bladders and enclosed chambers containing insulating media, the prior wet-mateable electrical connection assemblies also contain several mechanical components such as pistons, elastomeric sealings and the like. The purpose of these components is to prevent the influx of seawater or fluid into the electrical contact area. However, these bladders, chambers, mechanical components and elastomeric sealings cannot withstand the long term exposure to high pressure and temperature resulting in seawater or moisture penetration into the electrical contacts. As a result, the electrical contacts can develop short circuits, or worse, can fail completely. Once the moisture or fluids come into contact with the electrical contacts, the prior devices are not built to remedy such a failure. The current industry practice of using oil-bladder designs is complicated, causes high mating forces, results in bulky and heavy connectors which are difficult to maneuver, degrades in performance after exposure to temperature extremes, requires pressure compensation for the oil bladders, and limits the number of mate-demate cycles before maintenance is required. Current designs also operate over a narrow range of mating rates.

SUMMARY

Embodiments described herein provide wet-mateable electrical or data connectors suitable for applications within adverse environments, such as underwater. In comparison to the prior devices, the male contact pin and the female contact of the wet-mateable electrical connector are in contact with water/fluid when in fully-mated engagement. Additionally, example embodiments of the wet-mateable electrical or data connections may not require complex mechanical components, chambers or bladders containing insulating media and may be easily mated and de-mated within an adverse environment such as underwater.

In one embodiment, the wet-mateable electrical connector comprises a female connector body comprising at least one receptacle. A female contact is disposed within the receptacle. A male connector body having at least one axially directed male contact pin having a forward end portion releasably engages with the female contact, forming a releaseable, fully-mated engagement. In one aspect of this embodiment, the female connector body and the male connector body are in sealable contact with each other in the fully-mated engagement. According to one embodiment, the electrical connection between the male contact pin and the female contact may be made within or in the presence of adverse environmental conditions, such as under-sea water or other fluids that can adversely affect the electrical connection. According to one aspect, the male and the female contacts may be surrounded by fluids such as water in the fully-mated engagement, i.e., the electrical connection between the contacts is made in the presence of fluids. In this aspect, a tortuous water/fluid path may be created between the male and female electrical contacts and the environment surrounding the connectors. The tortuous water/fluid path may be created by, for example, channels or grooves defined on either of the contact surfaces of the male or female connector body that forms the sealable contact. The channels or grooves may be formed by suitable placement of water-tight sealings, for example, O-rings or rubber gaskets. The electricity/current can be lost to the surroundings of the connectors via the tortuous fluid path. However, the small cross sectional area and the long length of the channels or grooves may create a high ionic path resistance between the electrical contacts and the environment surrounding the connectors, and this resistance is high enough to have an insignificant effect on the operation of most electronic circuitry connected to the contacts.

Another embodiment of the invention is a method of wet-mateable electrical connection, comprising releasable engaging a female connector body comprising at least one receptacle that includes a female contact with a male connector body comprising at least one male contact pin, and providing for contact with water or fluid for the male contact pin and the female contact in an instance in which the male contact pin and the female contact pin are in a fully-mateable engagement. In this particular embodiment, the female connector body and the male connector body may be sealably engaged. The male contact pin may slidably engage with the receptacle, thereby fully-mateably engaging with the female contact within the receptacle. A high ionic resistance path may be created between the contact surfaces of the electrical contacts and the environment surrounding the connectors when they are in full-mateable engagement. The contact surface of the female connector body or the male connector body may define grooves or channels to create the high resistance ionic path.

Other aspects and advantages of embodiments of the invention will be apparent from the following description and the appended claims.

BRIEF DESCRIPTION OF THE DRAWINGS

FIG. 2A is a single male contact pin in a de-mated arrangement with a female contact (with a vent) in accordance with an example embodiment of the present invention;

DETAILED DESCRIPTION

Figure 1:
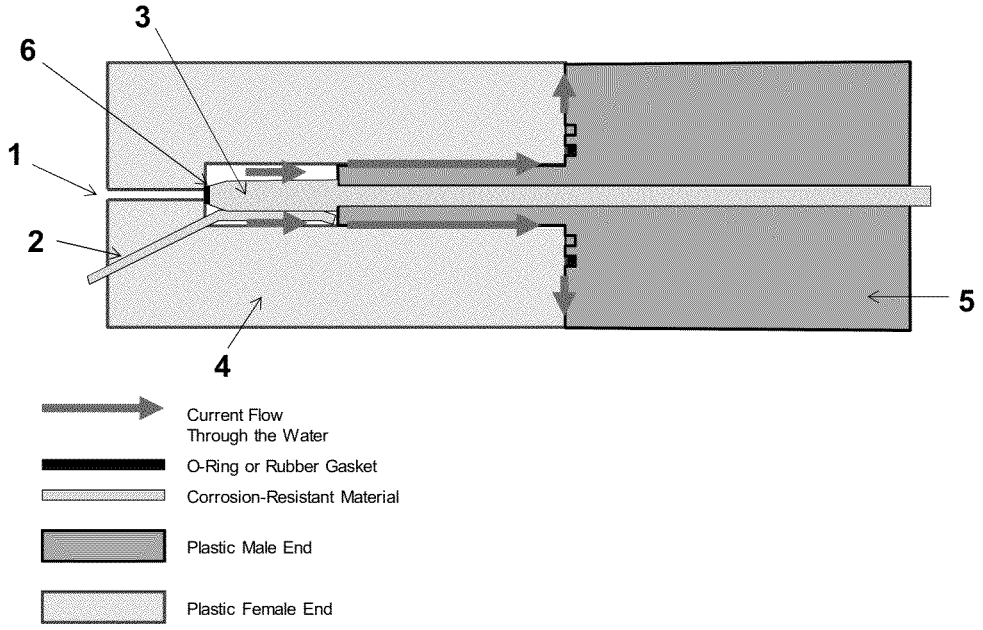
FIG. 1 is a single male contact pin mated with a female contact (with a vent) showing a high ionic resistance current path through the water in accordance with an example embodiment of the present invention.

Certain embodiments as disclosed herein provide for a wet-mateable electrical connection that can be used in submersible or adverse conditions, for joining one or more electrical circuits or data connections.

After reading this description, it will become apparent to one skilled in the art how to implement the invention in various alternative embodiments and alternative applications. However, although various embodiments of the present invention will be described herein, it is understood that these embodiments are presented by way of example only, and not limitation. As such, the detailed description of various alternative embodiments should not be construed to limit the scope or the breadth of the invention.

Current wet-mateable electrical connections generally use various techniques to insulate the electrical contacts from moisture, fluids or other impurities that could interfere with electrical connections. These techniques are costly, complex and the connections cannot be easily mated and de-mated multiple times. Additionally, multiple de-mating and high pressure and temperature conditions may result in destroying the fidelity of these constructions. As such, breach and failure of the currently available wet-mateable electrical connections may occur.

Rubber-molded, electrical wet-mateable connectors are currently made by several different ways. Some are molded of rubber such as Neoprene or Hypalon. These rubber materials are used to exclude water from the electrical contact areas. This design can be capable of fairly high pressures and is typically rated to 600 volts. It is small and inexpensive but is typically molded onto jacketed cables. This design is usually not used with oil-filed cables. It is used in the field, but the materials of construction limit temperature ratings. Metal-shell, electrical wet-mate connections are made by molding a rubber connector into a metal body, providing greater strength and stability along with positive keying and locking, but the design is otherwise similar to all-rubber connectors. Metal-shell connectors are more robust and are able to withstand more abusive environments than the molded rubber versions, but they still have the same pressure, voltage and temperature limitations. In all these designs, if the electrical contacts accidently come in contact with water, they will tend to corrode, especially under high pressure seawater or in high power applications.

Oil-filled, electrical wet-mate connectors exclude water from the electrical contact areas by using oil-filled bladders to flush water from the electrical contact areas. They are more robust, with an oil-filled and pressure-balanced metal-shell assembly that incorporates redundant sealing barriers to the environment. They are available as multi-pin connectors in a range of contact sizes and can be designed to function at high pressures and high voltages, but are still complicated and are constructed of materials which limit temperate ranges of applications. These are electrical connectors currently most suitable for extremely deep-water, critical long term applications. A new type of connector that uses gas to flush water from the electrical contacts is also presently on the market.

The wet-mateable electrical connections provided herein are particularly applicable to the electrical connections made within an adverse environment. An "adverse environment" in this context means an environment where the electrical/data connections must be made under adverse conditions, such as in the presence or in surrounding fluids that can interfere with the electrical connections, such as water, oil, mixtures of fluids and the like. One such example of an adverse environment is in the exploration and extraction of oil and gas from sub-sea deposits, e.g., deep sea well-drilling. The wet-mateable electrical connection provided herein may avoid the use of complex elastomer based sealings, chambers or bladders containing insulated media and the like, and allows the electrical connection between electrical contacts to operate even in the presence of fluids such as water, oil or other liquids.

Various embodiments of the invention will now be described with reference to the accompanying figures.

FIG. 1 shows a single male contact pin mated with a female contact and shows the male contact pin 3 in fully-mated engagement with the female contact 2. In this regard, "fully-mated engagement" means that the male contact pin and the female contact are engaged in such a way to form an electrical connection. The male contact pin extends from the front face of a male connector body 5. The male contact pin has a forward end, which is capped by a plug 6 made up of a suitable material. Generally, such materials can form a water-tight seal. Any material known in the art can be used to construct the plug 6. For example, in some embodiments, such materials could be rubber, polyurethane, PTFE or elastomeric polymers.

The male contact pin 3 is axially directed from the face of the male connector body 5 in the forward direction. The male connector body 5 extends co-axially with the male contact pin 3, and encloses or surrounds the male contact pin 3 as shown in FIG. 1. This arrangement facilitates the formation of a sealable arrangement with the receptacle 7 (shown in FIG. 2A) when the male contact pin 3 slides in to the receptacle 7, forming a fully-mated engagement with the female contact 2. In this sealable arrangement, the male connector body 5 that surrounds the male contact pin 3 and the annular walls of the receptacle 7 are in close contact with each other, only allowing the water/fluids present in the receptacle 7 to escape between the surface of the male connector body 5 that extend inside the receptacle, and the surface of the annular walls of the receptacle. In another embodiment the male connector body 5 does not extend into the female connector body 4. Any embodiment that allows the male contact pin 3 to electrically connect to the female contact pin 2 does not deviate from the scope of the invention.

The female connector body 4 comprises one or more receptacles 7 (shown in FIG. 2A). In the embodiment shown, the receptacle 7 is annular, however, various other shapes that could enhance the operation of the embodiments of the present invention can be employed. In some instances, receptacle 7 is a socket that receives the male pin. Generally, the receptacle 7 is complementary to and capable of coupling with a male pin. A spring loaded, female contact 2 is disposed within the receptacle 7. In the de-mated orientation in which there is no electrical connection between the male contact pin and the female contact, both the male connector body 5 and the female connector body 4 may be surrounded by water/fluids. The female connector body 4 defines at least one vent 1 which may be disposed at the end of the receptacle 7, directly opposite to the end into which the male contact pin is inserted. As the male contact pin slides into the receptacle 7, the water/fluids is forced out and expelled through the vent 1. Thus, the vent serves to alleviate the pressure. Accordingly, a vent placement can vary without deviating from the scope of the invention. And therefore, the water-tight sealing cap could be placed elsewhere within the male contact pin 3, in addition to or in place of, having the water-tight sealing cap on the forward end as shown in the embodiment above.

In one embodiment of the invention, grooves, channels or passages can be formed on the contact surface of the male connector body and/or the female connector body when the male contact pin and the female contact are in fully-mated engagement. In this context, the terms grooves, channel or passages are used here interchangeably. These passages can be formed by placing suitable sealing materials, such as O-rings or rubber gaskets on the contact face 9 of the male connector body 5 in a pre-designed orientation. The "contact face" in this context means the surface of the male connector body that forms a sealable arrangement with the body of the female connector body in the fully-mated engagement and vice versa. In this arrangement, the contact surfaces of the male and female connector bodies form a sealable arrangement, while the O-rings or the rubber gaskets 8 form the water/fluid-tight grooves or channels 10, comprising a first sidewall 11 and a second sidewall 12. These grooves or channels direct the path of water or fluids. The channels/or grooves have a small cross sectional area and form a long distance, tortuous pathway. The "tortuous pathway" in this context means a pathway that is long and narrow, and may have several twists and turns. Such a pathway, in one embodiment, has at least 2 turns. In one aspect of the invention, these orientations form a high ionic resistance water/fluid path/channel in which a path/passage is designated by grooves and/or channels with small cross sections and that extend for long distances.

Electricity or current can be lost to the surroundings by flowing through the external environment. For example, the electricity can be lost to the surroundings by conduction through appropriate conducting media, such as water. Accordingly, in the embodiments provided herein, the electricity can be lost through the tortuous fluid pathway. However, the unique tortuous pathway design as described above presents a higher resistance for ions to travel through this pathway to the connector surroundings. As such, the tortuous pathway creates a high resistance ionic path. As used herein, the tortuous pathway and the high resistance ionic path are synonymous with each other.

In the context of wet-mateable electrical connectors, current can initiate in one electrical contact and flow through the tortuous pathway into the surrounding water/fluids that is outside the connectors or between male and female contacts, or to another contact pin located within an adjacent connector by flowing through a tortuous pathway located within that connector. Additionally, current can be lost by flowing from the contact pins through external environment outside of the connectors (e.g., water) to any other structure that is within the external environment and which is at a different voltage than the electrical contact. For example, if there is a steel structure present within the proximity in the water, which may also be grounded to the same circuitry as that providing power to the connector, current could flow from the connector contact pin to that structure.

According to the embodiments of the wet-mateable electrical connector provided herein, in all these instances, the current has to flow through tortuous pathway(s) which present a high ionic resistance. As such, any loss of electricity is negligible in the operation of most of the electronic circuitry connected to the contacts. As used herein, the term "environment surrounding the connectors" refers to the external environment in which the connectors are located. For example, in embodiments of the wet-mateable electrical connectors, in some instances, the environment could be fluids surrounding the connectors. In some instances, the wet-mateable electrical connectors are surrounded by water.

In one embodiment, the small cross sectional area of the channels or grooves may be no more than 0.0005-in$^2$ and the length of the channels or grooves may be at least 3.0-in. In this embodiment, the only way the electricity can be lost is by the draining of the charged ions through the fluid path that is created on the contact surface of the male and female connector bodies. The small cross sections, long distances, twist and turns create a high resistance to ionic travel. The predesign patterns or designs thus create a high resistance ionic path on the contact surfaces of the male and the female connector bodies.

Figure 1A:
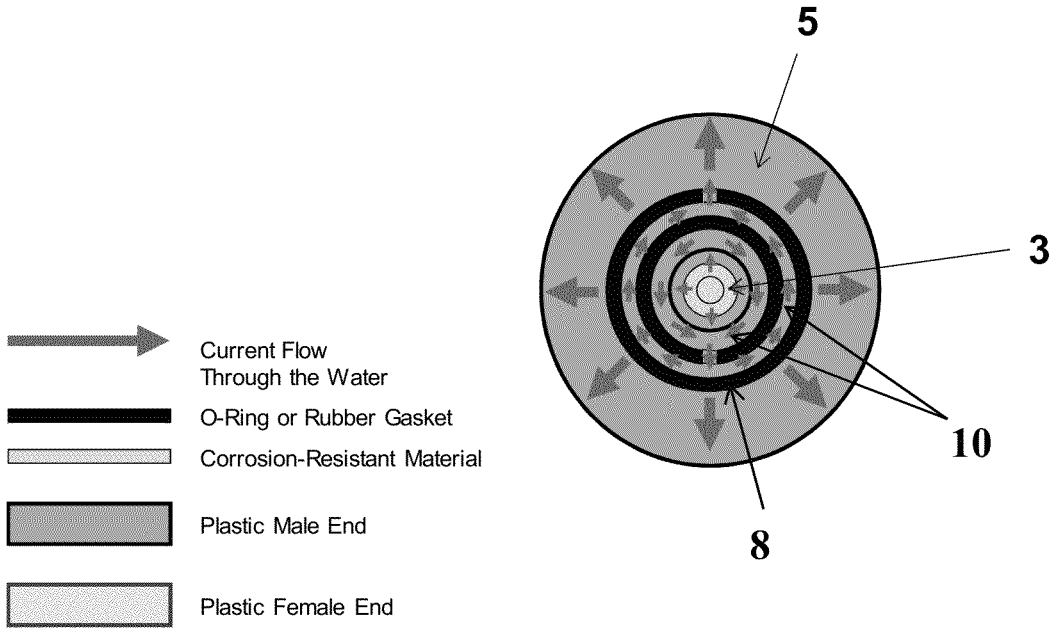
FIG. 1A is a contact surface of the male connector body showing a high ionic resistance water path (direction of water flow is shown in arrows) in accordance with an example embodiment of the present invention.

For example, FIG. 1A shows a labyrinth type channel 10 design constructed by O-rings or rubber gaskets 8 on the contact surface of the male connector body 5. The arrows indicate the path of the water/fluid (hence the path of the current through the water/fluid), once in contact with the contact surface of the female connector body 4. Accordingly, the high ionic resistance water/fluid path created at the contact surface of the male and female connector bodies at the fully-mated engagement creates a very high ionic resistance, such that any loss of electricity is negligible and insignificant in most electronic circuitry. Any other suitable channel or groove designs that can introduce such high resistance ionic path are within the scope of this invention.

For example, ionic water path resistance may be calculated for a wet-mateable connection comprising a single male contact pin as shown below. For purposes of this example, the following assumptions were made:

Pin diameter: 0.184-in

Pin height: 3.0-in

Pin gap: 0.001-in

Face Gap: 0.001-in

Radial difference between the inner O-ring and outer diameter (OD) and outer O-ring inner diameter (ID): 0.05-in Inner O-ring OD: 0.332-in O-ring slot width: 0.05-in Based on these assumptions:

Resistance due to a cylindrical shell of water around pin:

$R_1$=rL/A=20*3.0/(0.001*pi*0.184*2.54)=40,865-ohm

Two slots through O-rings:

$R_2$=rL/A=20*2*0.05/(0.001*0.05*2.54)=15,748-ohm

Two parallel paths between O-rings from one slot to the other slot:

$R_3$=rL/A=20*pi*0.332/(2*0.001*0.05*2.54)=15,322-ohm

Total resistance per pin: $R_1+R_2+R_3$=71,935-ohm

Where r=resistivity of the environment in ohm-cm

L=total length of ionic path in inches

A=cross-sectional area of ionic path in square inches

As shown above, water/fluid is present when the electrical connection is established between the male contact 3 and the female contact 2. Therefore, the male contact 3 and female contact 2 are formed of corrosion-resistant material. Any corrosion-resistant material can be used for this purpose. In some embodiments, any electrically-conducting material that is resistant to corrosion in the presence of fluids can be used. For example, the corrosion resistant material can be selected from the group consisting of titanium alloys, graphite, stainless steel, beryllium copper, platinum, alloys of platinum and iridium, niobium and nickel-base super alloys. In the embodiment shown in FIG. 1, the male contact 3 is embedded within the male connector body 5, and extends therethrough. In this embodiment, connections to power cables or data cables can be made at the back of the male connector body 5 (not shown). A similar set up is envisioned for the female connector body 4.

In some embodiments of the present invention, the wet-mateable electrical connection can be used in the presence of water. In other embodiments, the water-mateable electrical connection can be used in the presence of other fluids, either in addition to water or instead of water. For example, fluids other than water, such as production fluids from a wellbore, can be present when the electrical connection is made. In some instances, the water/fluids can fully-surround the electrical contacts. In some other instances, the water/fluids can partially-surround the electrical contacts. In some embodiments of the invention, insulation of the electrical/data contacts from water/fluids is not necessary, and as such, the chambers or bladders containing insulating media generally required in current wet-mateable connections may not be necessary. As used herein, the term "fluid" refers to liquids. In some embodiments of the present invention, the fluid is water. In some embodiments, the fluid is oil, and in some embodiments, the fluid is a mixture of liquids, such as oil and water. In particular, the liquids may adversely affect the electrical connections. In some embodiments of the present invention, the male and female connector bodies in the fully-mateable engagement minimize the presence of these adversely affecting fluids in the areas of electrical connections, but complete removal of such fluids is not necessary.

The male connector body 4 and the female connector body 5 can be constructed of any suitable material known in the skill of art. For example, water-repelling and insulating material such as plastics or elastomers can be used for this purpose.

Figures 2, 2B, 2C:
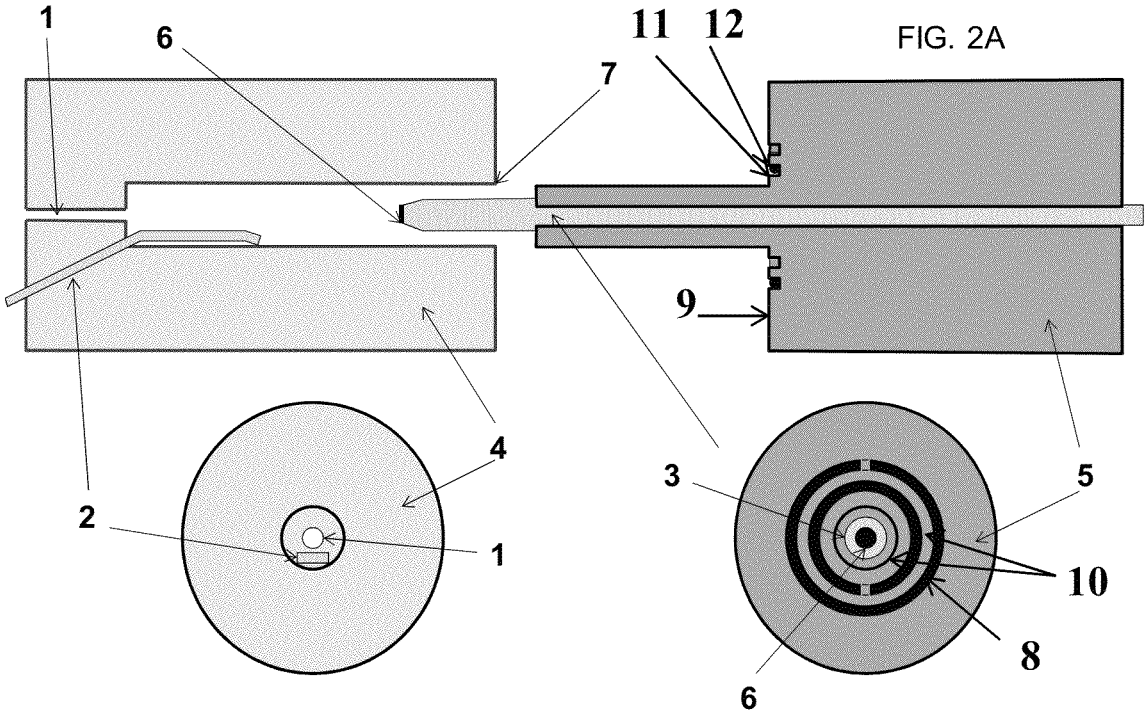
FIG. 2B is a front end view of a female connector body in accordance with an example embodiment of the present invention.
FIG. 2C is a front end view of a male connector body in accordance with an example embodiment of the present invention.

FIG. 2A shows a de-mated engagement of a single male contact pin and a female contact according to one embodiment of the invention. As shown, the female contact 2 is disposed within a receptacle 7 of the female connector body 4. See also FIG. 2B. FIG. 2C shows the contact surface 9 of the male connector body 5. In this embodiment, a labyrinth type design (including channel 10 formed by a first sidewall 11 and a second sidewall 12 as shown in FIG. 2A), formed by an O-ring or rubber gasket 8 is shown. This embodiment shows that the water/fluid movement is guided through one or more openings in the O-rings or rubber gaskets.

Figures 3, 3A, 3B:
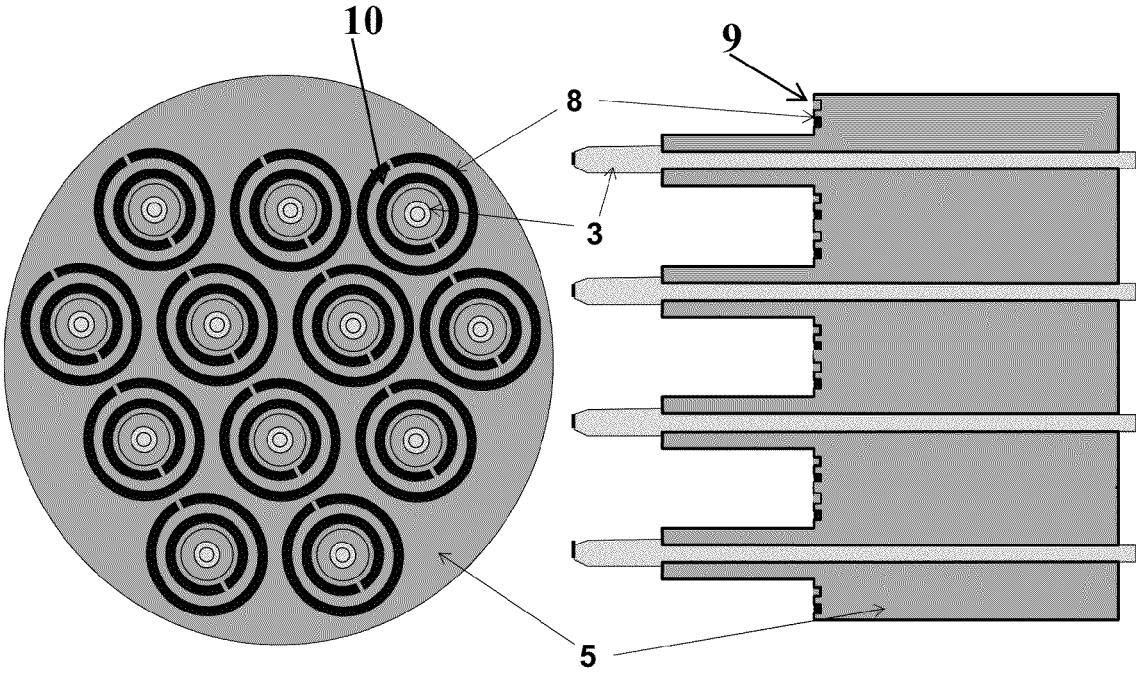
FIG. 3A is a front end view of a male contact 12-pin plug in accordance with an example embodiment of the present invention.
FIG. 3B is a cross section of a male contact 12-pin plug in accordance with an example embodiment of the present invention.

In one embodiment of the invention, a plurality of male contact pins can be formed on the male connector body. In this aspect, the male contact pins axially extend in the forward direction from the contact surface 9 of the male connector body 5. As discussed above, the male connector body 5 extends coaxially with the male contact pins. The male connector body 5 surrounds the male contact pins 3 at least partially and helps to form sealable arrangements with the receptacles, one example embodiment of which is shown in FIG. 3. FIG. 3A shows the front end view of the male connector body 5 of one embodiment comprising 12-pin male contacts, while FIG. 3B shows the cross section of such an embodiment. O-rings or rubber gaskets 8 that form the channels or grooves 10 can be seen on the contact surface 9 of the male connector body 5.

Figures 4, 4A, 4B:
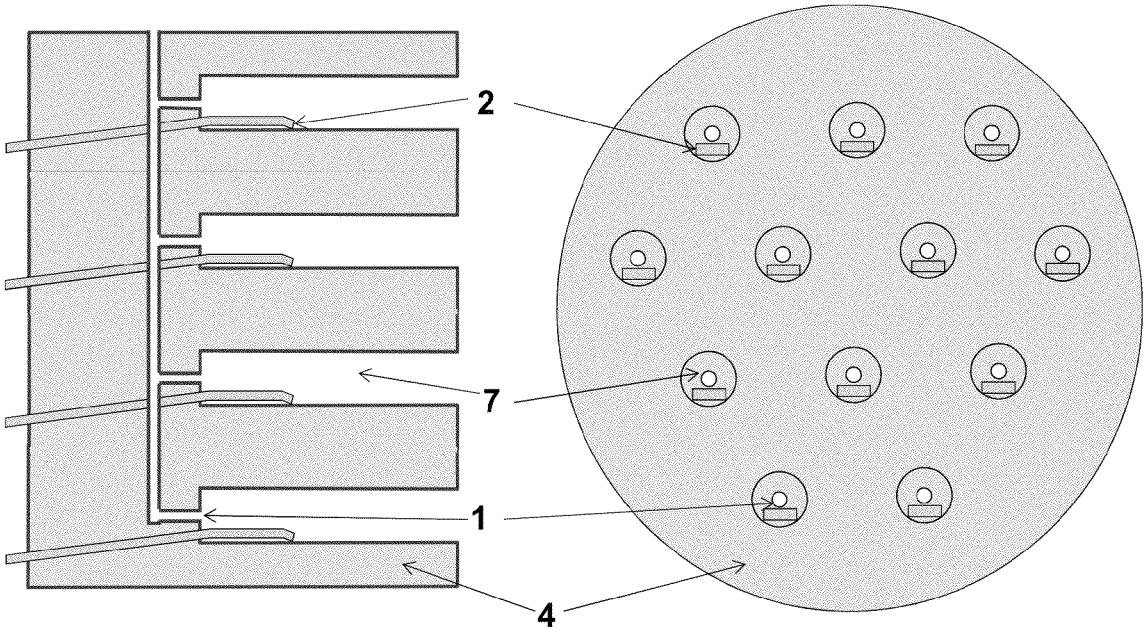
FIG. 4A is a cross section of a female connector body with 12-pin receptacles in accordance with an example embodiment of the present invention.
FIG. 4B is the front end view of a female connector body with 12-pin receptacles in accordance with an example embodiment of the present invention.

FIGS. 4A and 4B show the cross section and the front end view of the female connector body of one embodiment comprising the corresponding 12-pin receptacle that can be mated with the male connector body shown in FIG. 3.

Figure 5:
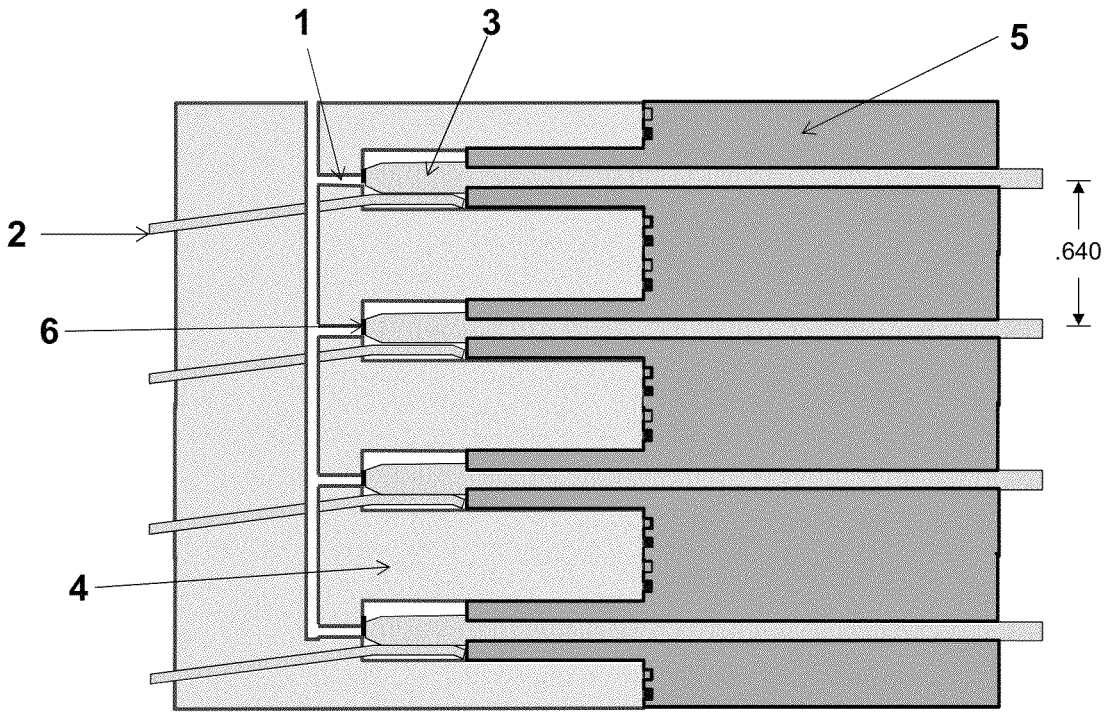
FIG. 5 is a cross section of the wet-mateable electrical connection with male and female contacts in fully-mated engagement (12-pin arrangement is shown) in accordance with an example embodiment of the present invention.

FIG. 5 shows the female connector body of FIG. 4 and the male connector body of FIG. 3 in the fully-mated engagement. In this embodiment, the distance between two male contact pins is 0.640-in.

Mating force is the frictional force that is created between male and female connectors as the two connectors are mated. The mating force can be damaging to the terminals and the electroplating. The high mating forces can also reduce the number of mating and de-mating cycles. In some embodiments, the male and female contacts are designed such that the mating force between them is low. In some such embodiments, the mating force of the male contact pin and the female contact in the fully-mateable engagement is between 0 and 1.0-lb. In some other embodiment, the mating force is between 1.0 and 10.0-lb. In some other embodiments, the mating force is 50.0-lb.

Figure 6:
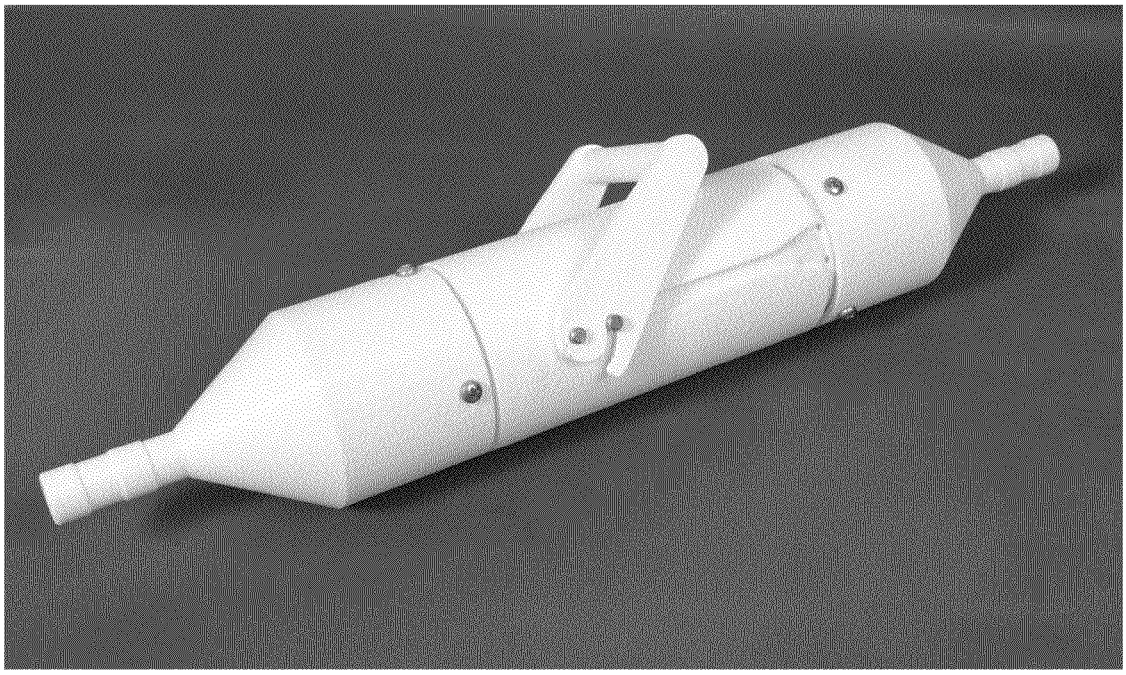
FIG. 6 is a physical model of the wet-mateable electrical connection in the fully-mated engagement in accordance with an example embodiment of the present invention.
Figure 7:
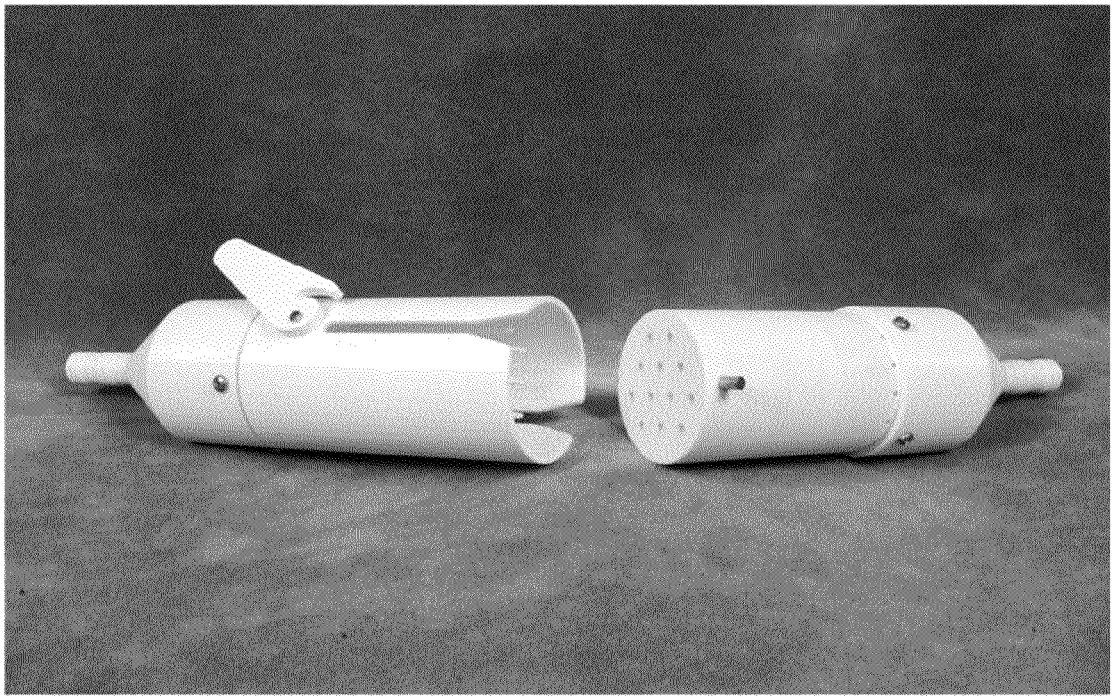
FIG. 7 is a physical model of the de-mated wet-mateable electrical connection in accordance with an example embodiment of the present invention.
Figure 8:
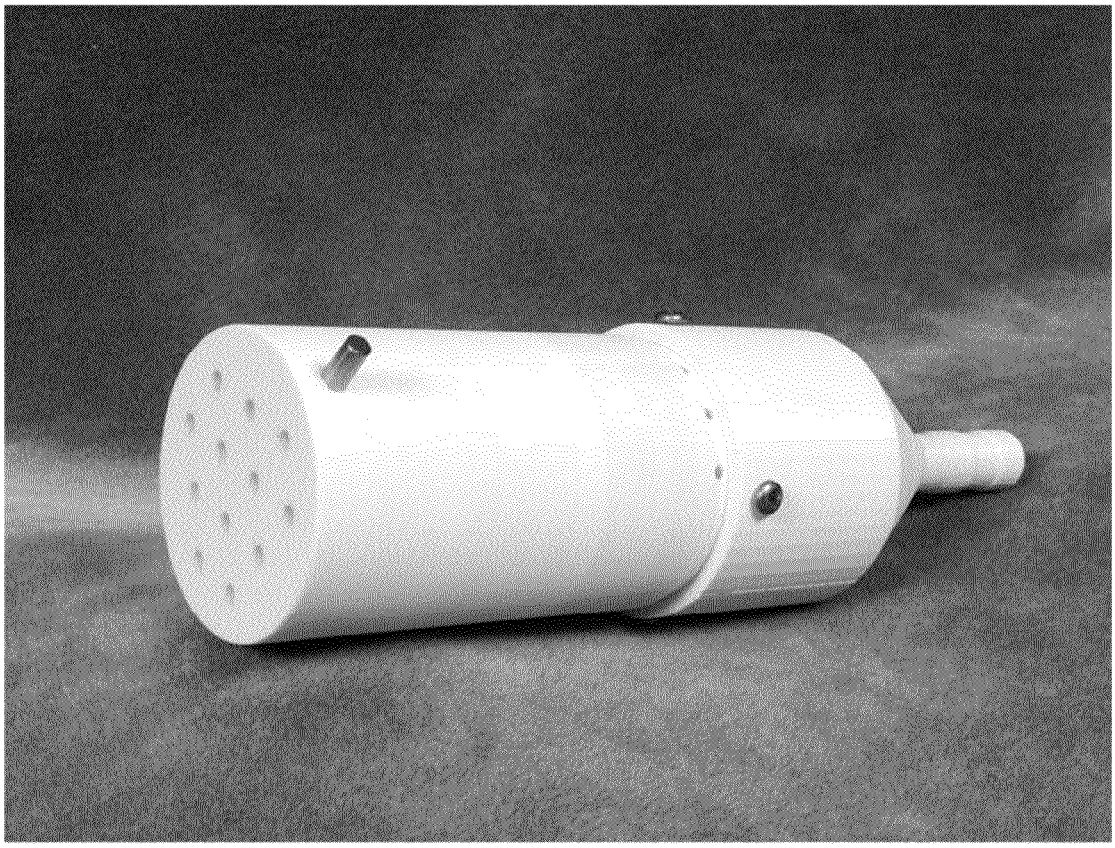
FIG. 8 is a physical model of the female connector body in accordance with an example embodiment of the present invention.
Figure 9:
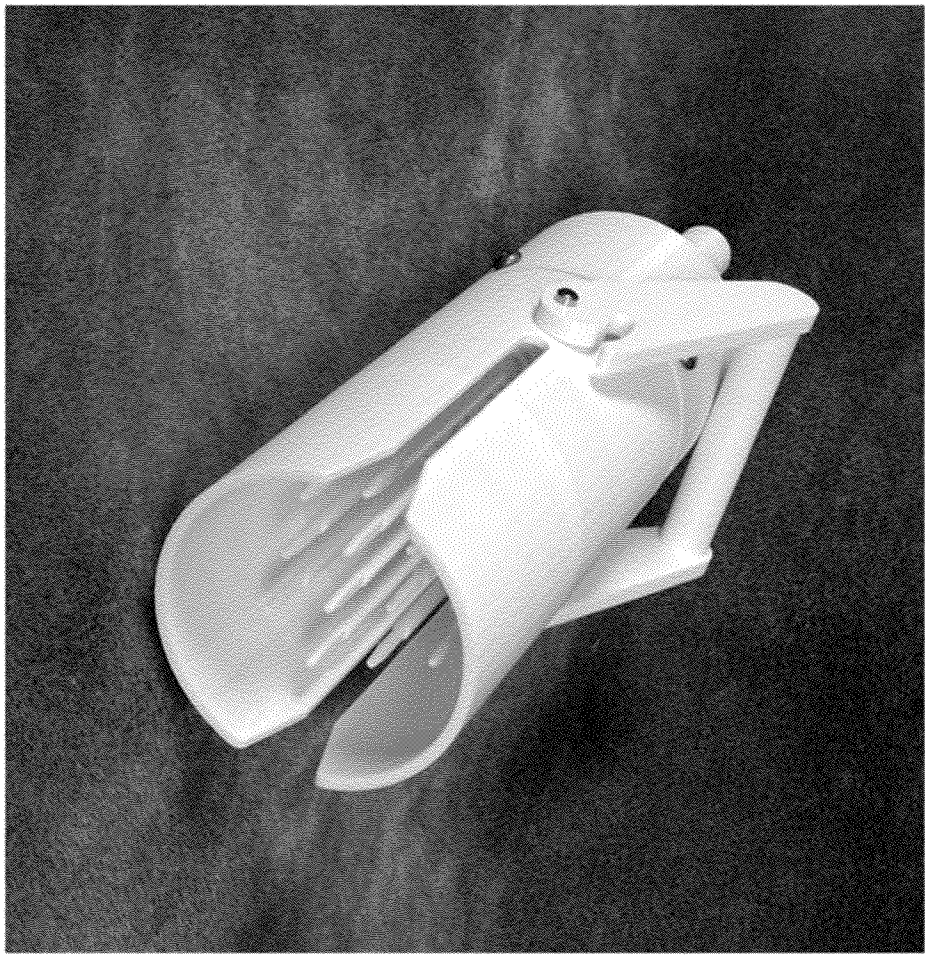
FIG. 9 is a physical model of the male connector body (showing an external sheath) in accordance with an example embodiment of the present invention.
Figure 10:
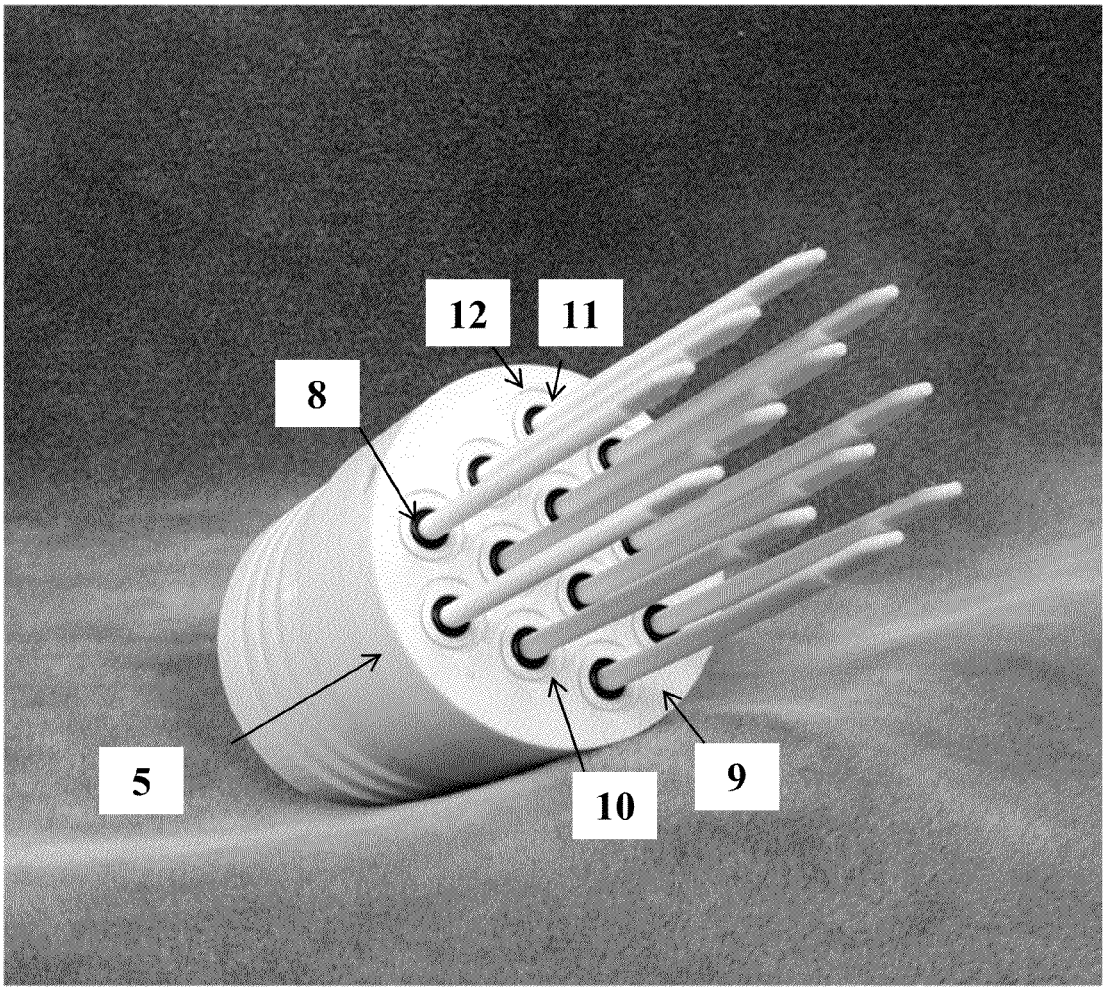
FIG. 10 is a physical model of the male connector body core in accordance with an example embodiment of the present invention.

FIG. 6 shows a physical model of one embodiment of a wet-mateable electrical connection. In this embodiment, an external sheath extending from the male connector body 5 covers the body of the female connector body 4. A space is left open for the vents so that water/fluids can be expelled. FIG. 9 shows the male connector body of this particular embodiment, showing the external sheath that extends and covers the female connector body in the fully-mated engagement. FIG. 10 shows the core of the male connector body of one embodiment after the removal of the external sheath. The channels 10, including a first sidewall 11 and a second sidewall 12, formed by the placement of the O-rings 8 can be seen on the contact surface 9 of the male connector body 5.

In another embodiment, a method of establishing a wet-mateable electrical connection is provided that includes releasably engaging a female connector body and a male connector body. The female connector body comprises at least one receptacle where a female contact is disposed therein. This female connector body releasably engages with a male connector body comprising at least one male contact pin, and the male and the female contacts form a fully-mateable engagement. "Releasable" in this context means that the male contact pins and the female contacts can be mated and de-mated as required, such as by sliding the axially directed male contact pin into the female socket or receptacle on the female connector body. According to one embodiment, in the fully-mateable engagement establishing the electrical connection, the male contact pins and the female contacts are in contact with water or a fluid. Thus, the electrical connection is established, in one embodiment, in the presence of water. In other embodiments, other fluids, such as production fluids from wellbore can be present.

In comparison to the current methods and designs, the inventive designs and methods are smaller, lighter, have fewer moving parts, have a lower mating force, allow for larger number of mate-de-mate cycles, do not degrade when stored at temperature extremes, operate over a wide range of mating rates and are fully-pressure compensated.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent presently preferred embodiments of the invention and are therefore representative of the subject matter broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A wet-mateable electrical connector in an adverse environment comprising:

a female connector body comprising at least one receptacle;

a female contact disposed within the at least one receptacle; and a male connector body having at least one axially directed male contact pin having a forward end portion; wherein the male contact pin and the female contact form a releasable fully-mated engagement, and wherein the male and female contact are in contact with fluids in the fully-mated engagement and wherein a high resistance ionic path is created between the male contact pin and the female contact and the environment surrounding the male contact pin and the female contact when the male contact pin and the female contact are fully-mateably engaged and wherein the high resistance ionic path comprises a channel defined by a first sidewall and a second sidewall extending axially from the contact surface of the female connector body or male connector body.

2. The wet-mateable electrical connector of claim 1, wherein the female connector body and the male connector body are in sealable contact with each other in the fully-mated engagement.

3. The wet-mateable electrical connector of claim 1, wherein a contact surface of the female connector body defines channels or grooves to create the high resistance ionic path between the male contact pin and the female contact and the environment surrounding the male contact pin and the female contact.

4. The wet-mateable electrical connector of claim 1, wherein a contact surface of the male connector body defines channels or grooves to create the high resistance ionic path between the male contact pin and the female contact and the environment surrounding the male contact pin and the female contact.

5. The wet-mateable electrical connector of claim 1, wherein a water-tight sealing on a contact surface of the male or the female connector body defines channels or grooves which creates the high resistance ionic path.

6. The wet-mateable electrical connector of claim 5, wherein the water tight sealing comprises an O-ring sealing or a rubber gasket sealing.

7. The wet-mateable electrical connector of claim 1, wherein the male contact pin and the female contact are formed of corrosion resistant material.

8. The wet-mateable electrical connector of claim 7, wherein the corrosion resistant material is selected from the group consisting of titanium alloys, graphite, stainless steel, beryllium copper, platinum, alloys of platinum and iridium, niobium and nickel-base super alloys.

9. The wet-mateable electrical connector of claim 1, wherein the female connector body defines at least one vent disposed within the receptacle.

10. The wet-mateable electrical connector of claim 1, wherein the male contact pin comprises a water-tight sealing cap.

11. The wet-mateable electrical connector of claim 10, wherein when the male contact pin and the female contact are in fully-mated engagement, the water tight sealing cap sealably closes a vent in the female connector body.

12. The wet-mateable electrical connector of claim 11, wherein the forward end portion of the male contact pin has the water-tight sealing cap, and wherein the vent is located at an end of the receptacle.

13. The wet-mateable electrical connector of claim 1, wherein the male connector body extends in a forward direction co-axially with the axially directed male contact pin.

14. The wet-mateable electrical connector of claim 1, wherein the male connector body surrounds a portion of the male contact pin, and wherein the male connector body sealably engages with the at least one female receptacle in the female connector body.

15. A method of establishing a wet-mateable electrical connection in an adverse environment, comprising:

releasably engaging a female connector body comprising at least one receptacle that includes a female contact with a male connector body comprising at least one male contact pin; and providing for contact with fluids for the male contact pin and the female contact in an instance in which the male contact pin and the female contact are in a fully-mateable engagement, wherein a high resistance ionic path is created between the male contact pin and the female contact and the environment surrounding the male contact pin and the female contact when the male contact pin and the female contact are fully-mateably engaged and wherein the high resistance ionic path comprises a channel defined by a first sidewall and a second sidewall extending axially from the contact surface of the female connector body or male connector body.

16. The method of claim 15, wherein the female connector body and the male connector body are sealably engaged in the fully-mateable engagement.

17. The method of claim 15, wherein the male contact pin slidably engages with the receptacle thereby fully-mateably engaging with the female contact within the receptacle.

18. The method of claim 16, wherein grooves or channels on a contact surface of the female connector body or the male connector body creates the high resistance ionic path between the male contact pin and the female contact and the environment surrounding the male contact pin and the female contact.

* * * * *